United States Patent [19]

Karpen

[11] 4,430,765

[45] Feb. 14, 1984

[54] FLAME RETARDANT MATTRESS

[76] Inventor: King Karpen, 407 #5 W. Duarte Rd., Arcadia, Calif. 91006

[21] Appl. No.: 253,072

[22] Filed: Apr. 10, 1981

[51] Int. Cl.[3] ..... A47C 7/02

[52] U.S. Cl. ..... 5/459; 5/472; 5/473; 5/474

[58] Field of Search ..... 5/448, 459, 471, 474, 5/472–473

[56] References Cited

U.S. PATENT DOCUMENTS

| | | | |
|---|---|---|---|
| 1,837,150 | 12/1931 | Dreyfus | 5/459 |
| 2,025,328 | 12/1935 | Bronstien | 5/474 |
| 2,152,237 | 3/1939 | Bechik | 5/474 |
| 2,363,637 | 11/1944 | Bows et al. | 5/474 |
| 2,382,496 | 8/1945 | Marsack | 5/448 |
| 2,624,894 | 1/1953 | McCarthy | 5/459 |

*Primary Examiner*—Alexander Grosz

*Assistant Examiner*—Michael F. Trettel

*Attorney, Agent, or Firm*—Beehler, Pavitt, Siegemund, Jagger & Martella

[57] ABSTRACT

A mattress of the type retardant to flame and entirely free of metal inner springs is built upon a basic box structure having side walls of relatively stiff, firm material, such as plastic impregnated ticking, to which top and bottom sheets of cotton fabric material is attached at respective adjacent edges. The box structure is filled with a mass of garnetted cotton felt in which is blended a quantity of boric acid powder to create a filling which will not support combustion under direct flame exposure. There is an additional top and bottom layer of cotton felt, also blended with a similar quantity of boric acid powder, and covered on both sides with plastic impregnated water resistant ticking, the ticking being stitched to corresponding edges of the side walls.

6 Claims, 9 Drawing Figures

Fig. 5.
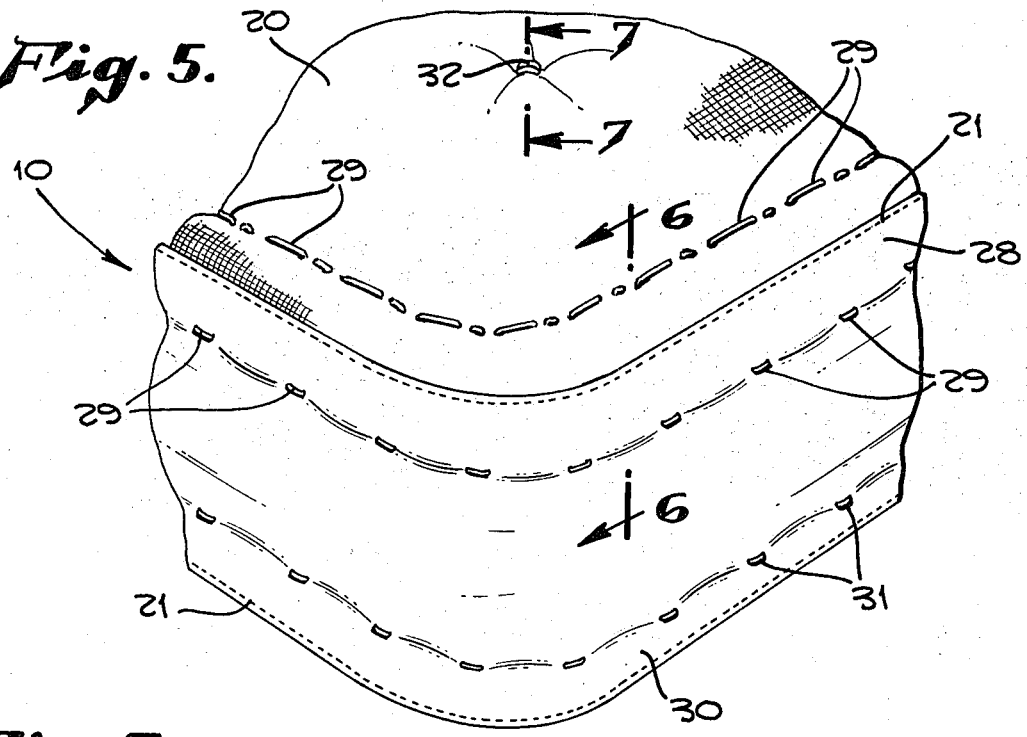
Fig. 7.
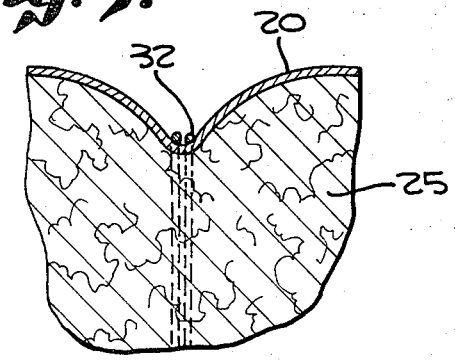
Fig. 8.
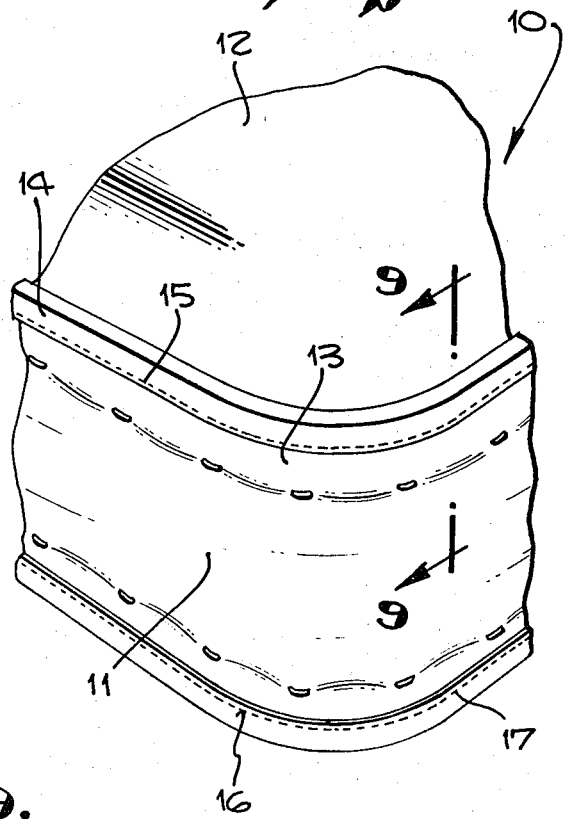
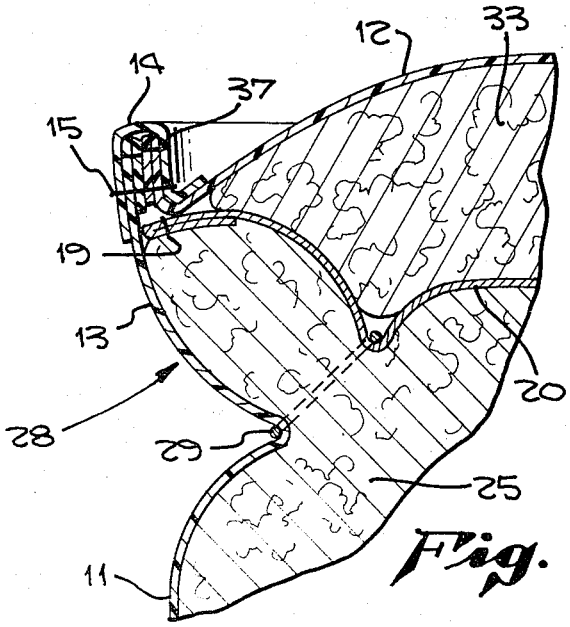
Fig. 9.

FLAME RETARDANT MATTRESS

Currently acceptable mattresses in widespread use feature employment of a metal inner spring. Such mattresses, properly constructed, although widely accepted for private use are not required to be of a flame retardant character.

When mattresses are to be used for sleeping accomodations in such places as prisons, mental hospitals and general hospital use, currently prevalent regulations require that they be flame retardant. Although such inner spring mattresses can be built so as, for example, to resist ignition from a smoldering cigarette by employing polyurethane foam material for the soft portion of the mattress, and chemically treated to retard ignition, such structures actually will support ignition under open flame exposure.

When mattresses are used in institutions such as prisons and mental hospitals, employment of steel inner spring units is prohibitive for the reason that inmates, under the stress of confinement, are prone to tear open the mattress, extract the coiled inner spring wire, and use it as a weapon, either to inflict self-harm, as in the case of mental institutions, or as weapon to attack other persons, as in the case of prison.

On those occasions where synthetic material chances to be polyurethane, or one of the other commercially available synthetic plastic resins, such mattresses will support ignition from an open flame. With neoprene,the product may be particularly uncomfortable or especially high priced. There is also the hazard of their being generated toxic fumes when such synthetic plastic resin materials are subjected to excessive heat.

It is therefore among the objects of the invention to provide a new and improved flame retardant mattress which is devoid of metal inner springs and which at the same time is durable, comfortable and sanitary.

Another object of the invention is to provide a new and improved mattress of acceptable characteristics which is of such construction that it will not support ignition under open flame exposure.

Another object of the invention is to provide a new and improved flame retardant mattress and method of making same, the result of which is a comfortable mattress of consistently dependable construction.

Still another object of the invention is to provide a flame retardant mattress and method of making the same, the result of which is a durable, comfortable and sanitary product at a more modest cost than flame retardant mattresses currently available.

Still another object of the invention is to provide a new and improved method for the production of a flame retardant mattress of desirable, comfortable and sanitary qualities which is of such character that the method can be consistently and dependently followed so as to produce a mattress of a desired character at a reasonable price.

Still further among the objects of the invention is to provide a durable, comfortable, sanitary mattress of a character acceptable to institutions such as prisons and mental institutions which is more flame retardant than those heretofore available constructed of synthetic materials and which is also lower in price than mattresses of other less satisfactory construction.

With these and other objects in view, the invention consists of the construction, arrangement and combination of the various parts of the device and method of making the same, serving as an example only of one or more of the embodiments of the invention, whereby the objects contemplated are attained, as hereinafter disclosed in the specification and drawings, and pointed out in the appended claims.

FIG. 5 is a view similar to FIG. 1 after the rolled edge and tufting has been completed.

FIG. 7 is a fragmentary sectional view on the line 7—7 of FIG. 5.

FIG. 8 is a fragmentary side elevational view of one corner of the completed mattress.

FIG. 9 is a fragmentary cross-sectional view on the line 9—9 of FIG. 8.

Figure 1:
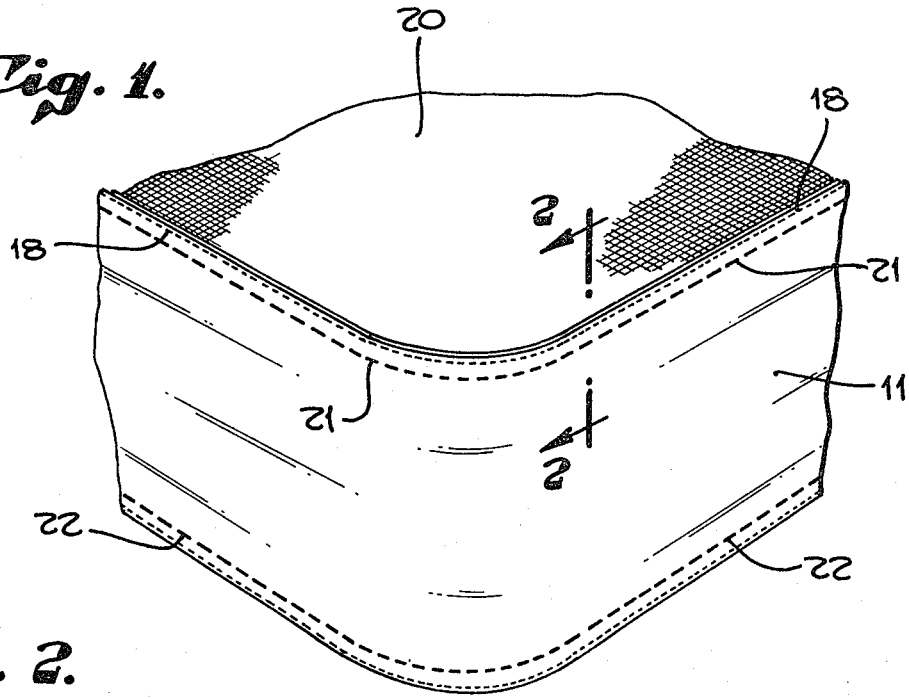
FIG. 1 is a fragmentary side perspective view of one corner of the mattress on completion of the initial step.
Figure 2:
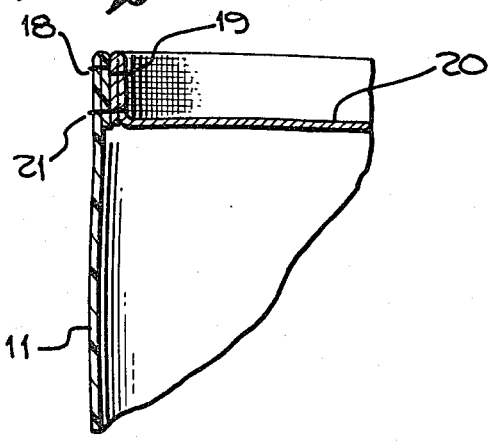
FIG. 2 is a fragmentary cross-sectional view on the line 2—2 of FIG. 1.
Figure 4:
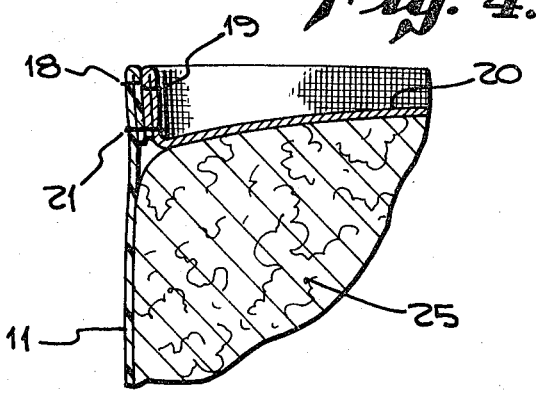
FIG. 4 is a view similar to FIG. 2 after filling.
Figure 3:
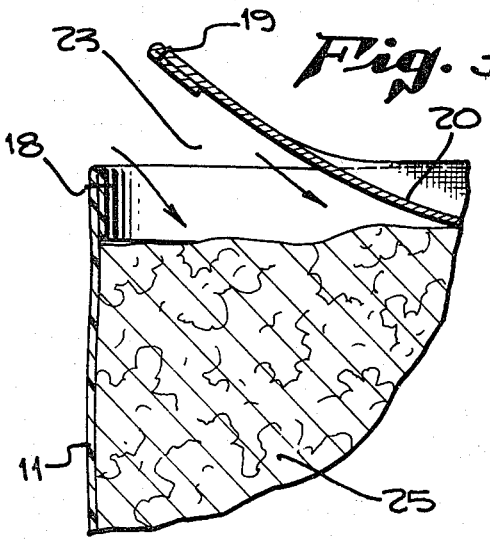
FIG. 3 is a fragmentary cross-sectional view similar to FIG. 2 but with a portion unstitched to leave an opening.
Figure 6:
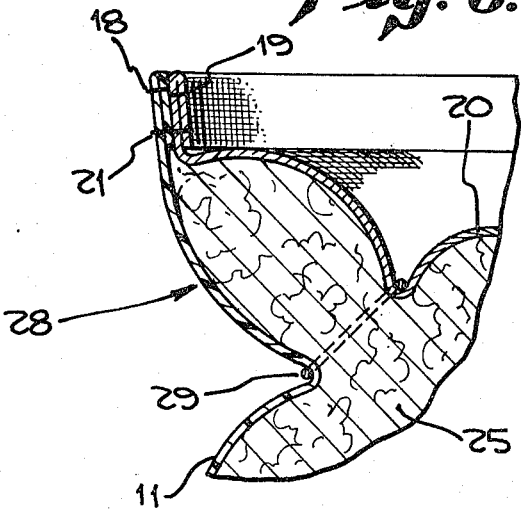
FIG. 6 is a view similar to FIG. 2 on the line 6—6 of FIG. 5.

In constructing the device of the invention, a basic mattress structure is involved, the building of which, to a degree, follows conventional procedure. For such basic structure, there is provided a side wall or band of fabric material, more specifically a plastic impregnated ticking. One currently acceptable material frequently used is identified as "Staph-Chek 20." The width of the side wall or band determines to a substantial degree the ultimate thickness of the resulting mattress. The band is made long enough to completely encircle the mattress, usually rectangular in shape, and sufficient to provide for a stitched connection at the abutting ends. Sheets of good quality muslin comprise the top and bottom of the mattress, in the present instance being actually subsurfaces and herein identified as subcovers. One of the subcovers is first stitched to a corresponding edge of the side wall at its perimeter, using essentially a chain-like stitch, namely one which can be readily removed at the proper time. The structure is then turned over and the other subsurface is similarly stitched to the opposite edge of the side wall. Stitching is omitted from one end of the bag so as to leave an opening for filling the interior.

Filling material for a mattress of the type here under consideration consists of a layered cotton felt which is garnetted and blended with boric acid powder in a conventional proportion sufficient to create a filling material that will not support combustion under direct flame exposure. The filling material following usual practice is in a quantity and of a weight appropriate and adequate to create a mattress of the length, width and thickness initially determined when the width of the side wall was selected. Cotton felt prepared in the manner described is then projected into the mattress bag by use of a filling machine extending through the opening initially provided. After the proper quantity of cotton felt has been deposited in the mattress bag, filling is discontinued and the opening closed with the same chain-like stitch as was employed in the first instance.

The bag now assumes the rough dimensions of the mattress structure. The next step is to stitch a rolled edge around the entire perimeter on both sides of the mattress bag. This is accomplished in a conventional fashion by use of a rolled edge stitching machine which runs a line of stitching spaced from the initial chain-like stitch the distance of an inch or two. Stitching along such an inside marginal line forms a rolled edge, the interior of which consists of a portion of the felted cotton filling material and the exterior of which consists on one side of a portion of the side wall structure and on the other side a portion of the subcover. The stitching entirely encircles one side of the mattress, after which the mattress is turned over and the same process repeated on the opposite side. In this way the mattress is tightened and forms a box-like appearance, which determines the exact dimensions of the mattress.

After the stitching has been completed, a pattern of lace tufts is formed throughout the surface of the mattress. Imposition of the lace tufts stabilizes the felted cotton filling material, preventing it from shifting or lumping. The tufting is essential for long life and wearing capacity of the mattress. Coupled with the tufting, the roll edge holds the shape of the mattress and retains its integrity during use.

After the foregoing steps have been accomplished, the chain stitching is removed as the next step in producing the mattress of the invention. With the mattress resting upon a suitable support, an additional layer of cotton felt impregnated with boric acid powder, appreciably thinner than the thickness of the mattress itself, is placed over the muslin subcover. To contain the additional layer of cotton felt, there is provided a surface cover of material comparable to that of the side wall, namely, a matching plastic impregnated ticking. The surface cover is then sewed in the opening formed by removal of the chain stitching, accompanied by a relatively narrow strip of tape to give it a desirable, neat-looking finish at the edge. This is a permanent lock-stitch which holds together the side wall, the subcover, the surface cover and the tape. After this has been accomplished on one side, the mattress is reversed on its support, and the same operation repeated for the opposite side.

It is significant that, by following the procedure described, holes made in the subcover by the tufting operation, which would be otherwise detrimental from a sanitary point of view, are entirely enclosed by the surface cover which, in company with the side wall structure, provides a sanitary surface throughout the entire mattress which can be cleaned at any time and which allows no penetration of fluid cleaning material to the interior of the mattress.

In an embodiment of the invention chosen for the purpose of illustration the ultimate flame retardant mattress product 10 is shown to good advantage in FIG. 8 where, because of the size, only a corner fragment is shown in the drawing. The final product includes a side wall structure 11 in the form of a band, which is adapted to extend entirely around the mattress. Customarily the mattress will be of rectangular form having side walls and end walls, although the advantages of the method and resulting products apply equally well to mattresses of other shapes. There is a top surface cover sheet 12 bound at its edge to a rolled edge 13 at the top of the side wall structure 11. The binding includes a strip of tape 14 secured by a line of stitching 15, the line of stitching being the means for fastening the surface cover sheet to the side wall structure. The surface cover sheet presents an unbroken surface over the entire top surface of the mattress. There is a similar cover sheet (not shown) on the bottom side secured by means of a similar strip of tape 16 by a line of stitching 17 to the corresponding edge of the side wall structure 11. Although top and bottom terms have been used, it should be understood that the mattress is reversible in that both top and bottom sides are identical.

Since the interior composition and the successive steps employed in producing the ultimate mattress of FIG. 8 are a significant part of the invention, reference is made to FIG. 1 and successive figures which show the initial and successive steps taken to produce the various parts of the mattress which are incorporated in the ultimate finished product.

At the top edge of the side wall structure 11 there is a line of hem stitching 18 merely to provide a hem at the edge to present the finished appearance. A similar line of hem stitching 19 extends around the entire edge of a subcover sheet 20. Good construction suggests that the subcover sheet be of a good grade of cotton muslin and that the side wall structure 11 be of a plastic impregnated ticking. In order to form the bag which ultimately contains the mattress material, the subcover 20 is stitched to the top edge of the side wall structure 11 by a line of chain-like stitching 21. The chain-like stitching is chosen so that it can be readily removed when required, as a step in the process of making the ultimate finished product.

There is a lower subcover (not shown) which is provided with a similarly stitched hem and which is attached to the lower edge of the side wall structure 11 by a similar line of chain-like stitching 22.

At this stage of construction, at least a portion of one side edge of either the upper or lower subcover is left unstitched by the chain-like stitching 21 in order to leave a filler opening 23.

Having made the mattress bag in the manner described, the general outlines of configuration of the mattress are established, such as the length, width and thickness. The next step consists of filling the bag with a filler material 25. The filler material comprises a blended mixture of cotton felt garnetted in a substantially conventional manner and blended with a special blend of boric acid powder in order to create the filler material which will not support combustion under direct flame exposure. The filler material is of a dimension and weight appropriate and adequate to create an acceptable mattress of the chosen length, width and thickness. The filler material is introduced through the filler opening 23. For this purpose resort is made to one or another of the commercially available filler machines. After the filler material has been deposited within the mattress bag, the filler opening 23 is closed by employment of the same chain-like stitch 21, or if more convenient, a lock-stitch as already made reference to. If a lock-stitch is used, the roll at the filling location can be opened by use of a sharp blade.

With the mattress bag filled and closed as described, the body of the bag may be pressed generally into shape and then have applied a stitched rolled edge, indicated generally by the reference character 28. A line of coarse rolled edge stitching 29 extends entirely around the circumference of the upper edge of the side wall structure 11 and, as a consequence, the entire perimeter of the subcover 20. After the rolled edge has been formed in this manner on one side of the mattress, the entire mattress can be turned over and a corresponding stitched rolled edge 30 formed on the opposite side by application of a similar coarse edge stitching 31. In this way the mattress is tightened and forms the desired box-like appearance, exact dimensions of the mattress having been determined in this fashion.

This step having been completed, a series of lace tufts 32 are installed through the body of the mattress, extending from the upper subcover 20 entirely through the filler material to the lower subcover. The lace tufts extend in a diamond pattern over the entire upper and lower surfaces of the subcovers.

The tufting having been completed, the mattress in this form is then laid on an appropriate support and the entire line of chain stitching removed, in this way to open the stitched rolled edge 28. The next step is to apply an additional layer 33 of cotton felt, this being peferably the same type of cotton felt garnetted and blended with boric acid powder as previously made reference to, but being applied as a relatively thin layer, extending over the entire top surface of the subcover sheet 20. This having been accomplished, the surface cover sheet 12, previously made reference to, is applied over the layer of cotton felt 33. The surface cover sheet is preferably a plastic impregnated ticking similar in character to the side wall structure 11. The surface cover sheet is secured to the side wall structure by means of the tape 14 and appropriate line of permanent stitching 15. For good construction, there may also be a hem around the perimeter of the surface cover sheet 12 secured by a line of hem stitching 37. Since the surface cover sheet 12 is entirely unbroken by any lace tufting, there is provided a sanitary surface impervious to penetration by usual liquids and which can be readily wiped clean when necessary.

The opposite side of the mattress is similarly constructed by opening the rolled edge by removal of the corresponding line of chain-like stitching, thereby to open the corresponding rolled edge 30. A similar layer of treated cotton felt, like the layer 33, is applied to that side, then covered by a surface cover sheet like the cover sheet 12, which is ultimately fastened to the corresponding side edge of the side wall structure 11 by a line of permanent stitching like the stitching 15.

By combining the properties of flame retardant cotton, the technique of making the roll on the edge and inner tufting, with the characteristics of a second layer of flame retardant cotton covered with substantially waterproof surface ticking, an acceptable mattress results which is free of any metal. The resulting mattress, moreover, provides a comfortable sleeping surface which remains substantially resistant to ignition by opening flame exposure, which assures against possible toxicity which would otherwise result in the event of fire. By making both surfaces of the mattress in this fashion, the product is additionally one which can be readily kept in sanitary condition.

While a particular embodiment of the present invention has been shown and described, it will be obvious to those skilled in the art that changes and modifications may be made without departing from the invention in its broader aspects, and therefore, the aim of its appended claims is to cover all such changes and modifications as fall within the true spirit and scope of this invention.

Having described the invention, what is claimed as new in support of Letters Patent is as follows:

1. A flame retardant mattress comprising an exposed perimetral side wall of a single thickness of sheet material and opposite parallel subcover sheets of fabric forming with said perimetral wall a complete substantially rectangular bag with stitched upper and lower cover edges, and a full complement of filler forming substantially the entire contents of said bag, said filler comprising a mass of cotton felt in which is blended a quantity of flame retardant chemical, a roll edge around the perimeter of each subcover sheet forming a corner, said roll edge comprising in part perimetral portions respectively of said side wall and said adjacent subcover sheet and including a portion of said cotton felt in impregnated condition and a marginal line of stitching, said marginal line of stitching extending between the side wall and the adjacent subcover sheet and through the cotton felt, a surface cover sheet imperforate intermediate edge portions, there being a surface cover sheet over the outside of each subcover sheet and forming an exterior space therebetween, a layer of cotton felt impregnated with a quantity of flame retardant chemical in each said space, and a stitched perimetral closure seam around each edge of the side wall, said closure seam comprising marginal edges respectively of the side wall of single thickness and adjacent surface cover sheet in face to face engagement and with a line of permanent stitching through said marginal edges, said closure seam being at a location clear of said subcover sheet.

2. A flame retardant mattress as in claim 1 wherein there is a pattern of tufting extending from one subcover sheet through the mass of said cotton felt to the other subcover sheet throughout the area of said subcover sheets and beneath said surface cover sheets.

3. A flame retardant mattress as in claim 1 wherein there is a strip of tape extending over the marginal edges on each side and anchored to the marginal edges by said line of permanent stitching.

4. A flame retardant mattress as in claim 3 wherein there is a hem extending around the perimeter of each subcover sheet and positioned adjacent to but separate from the respective marginal edges.

5. A flame retardant mattress as in claim 1 wherein said flame retardant chemical is boric acid powder.

6. A flame retardant mattress as in claim 1 wherein said side wall fabric and said surface cover sheets are impregnated with plastic.

* * * * *